US006590507B2

(12) United States Patent
Burns

(10) Patent No.: US 6,590,507 B2
(45) Date of Patent: Jul. 8, 2003

(54) METHOD AND SYSTEM FOR PROVIDING PERSONALIZED TRAFFIC ALERTS

(75) Inventor: Ronnie Burns, Irvine, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/800,916

(22) Filed: Mar. 5, 2001

(65) Prior Publication Data

US 2002/0121989 A1 Sep. 5, 2002

(51) Int. Cl.[7] ..... G08G 1/123
(52) U.S. Cl. ..... 340/995.13; 340/905; 701/213
(58) Field of Search ..... 340/905, 995, 340/995.13; 701/117, 213, 202, 208

(56) References Cited

U.S. PATENT DOCUMENTS 5,627,549 A * 5/1997 Park ..... 342/357
5,635,924 A * 6/1997 Tran et al. ..... 340/905
5,648,768 A * 7/1997 Bouve ..... 340/988
5,900,825 A * 5/1999 Pressel et al. ..... 340/905
5,919,246 A * 7/1999 Waizmann et al. ..... 701/209
6,111,521 A * 8/2000 Mulder ..... 340/905
6,256,577 B1 * 7/2001 Graunke ..... 701/117
6,313,761 B1 * 11/2001 Shinada ..... 340/995

* cited by examiner

*Primary Examiner*—Brent A. Swarthout
(74) *Attorney, Agent, or Firm*—Tope-McKay & Associates

(57) ABSTRACT

A method and system for providing personalized traffic alerts to a user by automatic processing of vehicle position and traffic alert conditions. The system employs at least one user portion and a server portion, wherein the server portion provides the user portion with traffic alert information. The user portion comprises a receiver, a position locator, a processor, a memory storage area, and an output device. The processor calculates the vehicle trajectory and in addition, the processor can predict the vehicle route based on the calculated vehicle trajectory, and historical routes in the memory storage area. The processor also correlates relevant traffic alerts by comparing the traffic alert information with the calculated vehicle trajectory or the predicted vehicle route. In another embodiment, the user portion further includes an input device for user determined routes and personalized user parameters for route weighting factors in predicting the vehicle route as well as traffic alert cone parameters and time to intersect traffic alert parameters for providing user selectable thresholds for generating pertinent essential and personalized traffic alerts.

5 Claims, 5 Drawing Sheets

METHOD AND SYSTEM FOR PROVIDING PERSONALIZED TRAFFIC ALERTS

TECHNICAL FIELD

The present invention is related to the field of monitoring vehicle traffic information. More specifically, this disclosure presents a method and system for predicting the encounter of an abnormal traffic situation based on direction of travel and traffic alerts.

BACKGROUND

Currently in large metropolitan areas, a driver may unexpectedly get tied up in abnormal traffic situations due to accidents and roadwork occurring somewhere in the driver's path. In order to avoid traffic jams or traffic slowdowns, advance warning is required so a driver can avoid areas where the undesirable traffic situations exist. One way to avoid traffic jams or traffic slowdowns is to constantly monitor different stations that provide traffic reports. However, to receive the appropriate report, the driver must 1) have the station on (and the station must be transmitting traffic reports for the driver's area of concern); 2) be paying attention to the report; and 3) interpret the report and relate it to his or her route. Although these reports can be quite helpful to individual operators of motor vehicles, for the most part such reports are "spotty." Drivers utilizing the existing traffic monitoring systems are subject to "information overload." This information overload occurs when there is more information provided to the person than he or she is able to analyze. In order to use either congestion or alternative routing information effectively, a driver would have the information available and be familiar with the locale and street names to take advantage of this information.

Information relevant to attempts to address these problems can be found in U.S. Pat. Nos. 4,792,803; 5,173,691; 5,864,305; 5,900,825; and 6,014,090. However, each one of these references suffers from one or more of the following disadvantages: 1) the inability to calculate and project the predicted vehicle trajectory; 2) the requirement that the user or driver be familiar with the driving area; 3) the user overload caused by attempting to keep up with alert locations as well as the current vehicle location; 4) the inability to predict the route by comparing current positions with the previously driven routes to reduce user workload and information reliability; and 5) the inability to filter information relevant to the vehicle's actual direction of travel.

Thus, it is desirable to provide a system that overcomes these limitations by automatically 1) processing information describing traffic alert conditions; 2) processing the current position and velocity (speed and direction) of the user's vehicle; 3) maintaining a database of historical routes to determine predicted vehicle trajectory; 4) providing traffic alert alarms from among a set of potential alarms based on at least one user selectable threshold that is personalized for that user; and 5) correlating the predicted vehicle trajectory with traffic alerts by automatically processing a combination of the vehicle's predicted route and the user selectable parameters so that those traffic alerts that could affect the driver would be automatically and essentially instantaneously brought to his or her attention with minimal input by the user.

SUMMARY OF THE PRESENT INVENTION

It is a primary object of the present invention to provide a system and a method for providing personalized traffic alerts. The system of the present invention, in one embodiment, comprises a traffic alert system, which includes a server portion and at least one user portion for providing personalized traffic alerts along a route. The server portion provides the user portion with the collected, compiled, and transmitted traffic alert information, including a traffic alert location. The user portion comprises a receiver in communication with the server portion for receiving the traffic alert information from the server portion, a position locator for determining a time-stamped position of the user portion, a user portion processor operationally connected with the receiver and the position locator to receive the traffic alert information and the time-stamped position of the user portion, to calculate a vehicle trajectory and velocity based on the time-stamped position, and to correlate a traffic alert along the calculated vehicle trajectory, a memory storage area including a historical route database wherein the memory storage area is operationally connected with the user portion processor to store and retrieve historical route data, and a predicted vehicle route may be determined within the user portion processor. In this case the processor analyzes the historical route database to locate a potential match with the calculated vehicle trajectory, and when the potential match is found, the potential match becomes the predicted vehicle route. If no potential match route is found, the calculated vehicle trajectory is used as the predicted vehicle route. An output device operationally connected with the user portion processor to alert a user when the traffic alert is correlated. Upon the occurrence of an end event, the user portion processor stores a sum of the time-stamped positions in the historical route database.

Another embodiment may further include, a personalized user parameter database comprising data including a user determined route, traffic alert cone parameters, a time to intersect traffic alert for warning and at least one route weighing factor may be stored within the memory storage area. In this case, an input device is operationally connected with the user portion processor for entering the personalized user parameters into the user portion processor followed by the user portion processor storing the entered personalized user parameters in the memory storage area. The user portion processor further determines the predicted vehicle route by comparing within the user portion processor the user determined route, the historical route database and the calculated vehicle trajectory using the route weighting factor entered by the user to determine the weight to give each comparison in selecting from the group consisting of the user determined route, the historical route database and the calculated vehicle trajectory for the predicted vehicle route. The traffic alert correlation can be further personalized by the user portion processor by including the personalized user parameters of the traffic alert cone parameters and the time to intersect traffic alert for warning in the correlations to determine whether to issue a traffic alert.

In another embodiment or aspect, the present invention comprises a traffic alert server portion for transmitting traffic alert information in communication with at least one user portion having a receiver for the traffic alert information, a position locator for determining a position of the user portion, a processor for calculating a vehicle trajectory and correlating a traffic alert along the calculated vehicle trajectory and an output device to alert a user when the traffic alert is correlated. The traffic alert information includes a location of the traffic alert. The server portion comprises a collector of the traffic alert information from numerous sources, a compiler operationally connected with the collector to compile the collected traffic alert information into a traffic alert system-readable format, and a transmitter operationally connected with the compiler for communicating the compiled traffic alert information to the user portion.

In yet another embodiment or aspect, the present invention comprises a system for providing personalized traffic alerts comprising a traffic alert system, which includes a traffic alert server portion and a traffic alert user portion in communication with the server portion, wherein the server portion includes, a means for collecting a traffic alert information from numerous sources, a means for compiling the traffic alert information into a traffic alert system-readable format operationally connected with the means of collecting, and a means for transmitting the traffic alert information to the user portion with the means for transmitting operationally connected with the means of compiling. The user portion includes a user portion receiver in communication with the server portion to receive the transmitted traffic alert information in the user portion, a user portion processor operationally connected with the user portion receiver to receive the received traffic alert information, and an input device operationally connected with the user portion processor to allow for entry of a user determined route and personalized user parameters into the user portion processor. The user portion also includes a position locator with a time-stamped position output operationally connected with the user portion processor for sending the time-stamped output into the user portion processor. A memory storage area also includes a historical route database area, for storing the historical route database, the personalized user parameters and the user-determined route operationally connected with the user portion processor. The user portion processor further configured to determine a calculated vehicle trajectory based on the received time-stamped position, to compare the calculated vehicle trajectory with both the user determined route and the stored historical route database to determine a predicted vehicle route, to correlate a traffic alert along a route by correlating the traffic alert information locations and the predicted vehicle route to determine a probability of a traffic alert intersect, and to determine if the time and the probability are within the personalized user parameters. An output device operationally connected with the user portion processor is provided to output the traffic alert to the user. The user portion processor also sums and stores the time-stamped positions along the route in the historical route database for later reference.

The present invention also comprises the provision of a method for providing personalized traffic alerts along a route to at least one user portion, with each of the user portions including a receiver for traffic alert information from an information source operationally connected with a user portion processor for calculating vehicle trajectory and correlating a traffic alert operationally connected with a position locator and a memory storage area operationally connected with the user portion processor for storing and analyzing historical route database and the user portion processor operationally connected with an output device.

Specifically, the method comprises steps of:

a. receiving traffic alert information including a traffic alert location for the traffic alert information from the information source;

b. receiving a time-stamped position from the position locator;

c. calculating a vehicle trajectory based on the received time-stamped position;

d. determining a predicted vehicle route by analyzing the historical route database to locate a potential match with the calculated vehicle trajectory, when a potential match is found the potential match becomes the predicted vehicle route, otherwise the calculated vehicle trajectory is the predicted vehicle route;

e. correlating the traffic alert along the predicted vehicle route by comparing the received traffic alert information location and the predicted vehicle route to correlate if the received traffic alert information location and the predicted vehicle route coincide;

f. outputting to the output display the correlated traffic alert;

g. repeating the receiving step a through the outputting step f until the end event; and h. storing a sum of the time-stamped positions in the historical route database memory storage area for later use in analyzing the historical route database.

Another embodiment, or aspect, of the present invention further includes an input device, and the memory storage area further including a database for personalized user parameters, and a user determined route. The input device and the memory storage area are operationally connected with the user portion processor. The method further comprises steps of:

a. receiving transmitted traffic alert information in the user portion from the server portion;

b. receiving a time-stamped position from the position locator;

c. storing the received time-stamped position in the memory storage area;

d. calculating a vehicle trajectory based on the received time-stamped position;

e. entering the personalized user parameters including a traffic alert cone parameters, a time to intersect traffic alert for warning, and at least one route weighing factor into the user portion processor via an input device when desired;

f. storing the entered personalized user parameters in the memory storage area;

g. receiving the user determined route into the user portion via the input device when desired;

h. storing the user determined route, when entered, in a user determined route database in the memory storage area;

i. determining the predicted vehicle route by analyzing the calculated vehicle trajectory, the historical route database, and the user determined route with the personalized user parameters for the route weighting factor to determine which has the highest route weighting factor and is determined to be the predicted vehicle route;

j. correlating the traffic alert information location and the predicted vehicle route to determine if the traffic alert information location and the predicted vehicle route coincide, by further correlating a traffic alert intersect probability by comparing the predicted vehicle route, the traffic alert cone parameters, and the traffic alert area with the personalized user parameters to determine if an intersection with the traffic alert is probable, and by further correlating a time to intersect the traffic alert along the predicted vehicle route by comparing the predicted vehicle route and the traffic alert information to derive the time to intersect the traffic alert and comparing the time to intersect with the personalized user parameters for the time to intersect to correlate if the time to intersect the traffic alert parameters are met;

k. outputting a signal from the output device when an intersection with a traffic alert is probable as determined in step j;

l. repeating the receiving step a through the outputting step k until the end event; and m. storing a sum of the time-stamped positions in the historical route database memory storage area for later use in analyzing the historical route database.

The present invention also comprises the provision of a method for providing traffic alert information along a route from a server portion to at least one user portion, with each of the user portions including a receiver for traffic alert information from an information source operationally connected with a user portion processor for calculating vehicle trajectory and correlating a traffic alert operationally connected with a position locator operationally connected with an output device, with each of the server portions including a means for collecting traffic alert information operationally connected with a means for compiling the collected traffic alert information operationally connected with a means for transmitting the compiled traffic alert information.

Specifically, the method comprises the steps of:

a. collecting traffic alert information including a traffic alert location for the traffic alert information in the server portion;

b. compiling the collected traffic alert information into a traffic alert system-readable format; and c. transmitting the compiled traffic alert information from the server portion to the user portion.

BRIEF DESCRIPTION OF THE DRAWINGS

These and other features, aspects, and advantages of the present invention will become better understood with regard to the following description, appended claims, and accompanying drawings where:

DETAILED DESCRIPTION

The present invention relates to an automatic personalized traffic alert system, and may be tailored to a variety of applications. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

The present invention is useful for predicting the direction of travel of a vehicle and for providing information regarding traffic alerts along that direction. A few of the goals of the present invention include providing a system that automatically 1) processes information describing traffic alert conditions; 2) processes the current position and velocity (speed and direction) of the user's vehicle; 3) maintains a database of historical routes to determine predicted vehicle trajectory; 4) provides traffic alert alarms from among a set of potential alarms based on at least one user selectable threshold that is personalized for that user; and 5) correlates the predicted vehicle trajectory with traffic alerts by automatically processing a combination of the vehicle's predicted route and the user selectable parameters so that those traffic alerts that could affect the driver would be automatically and essentially instantaneously brought to his or her attention with minimal input by the user.

Figure 1:
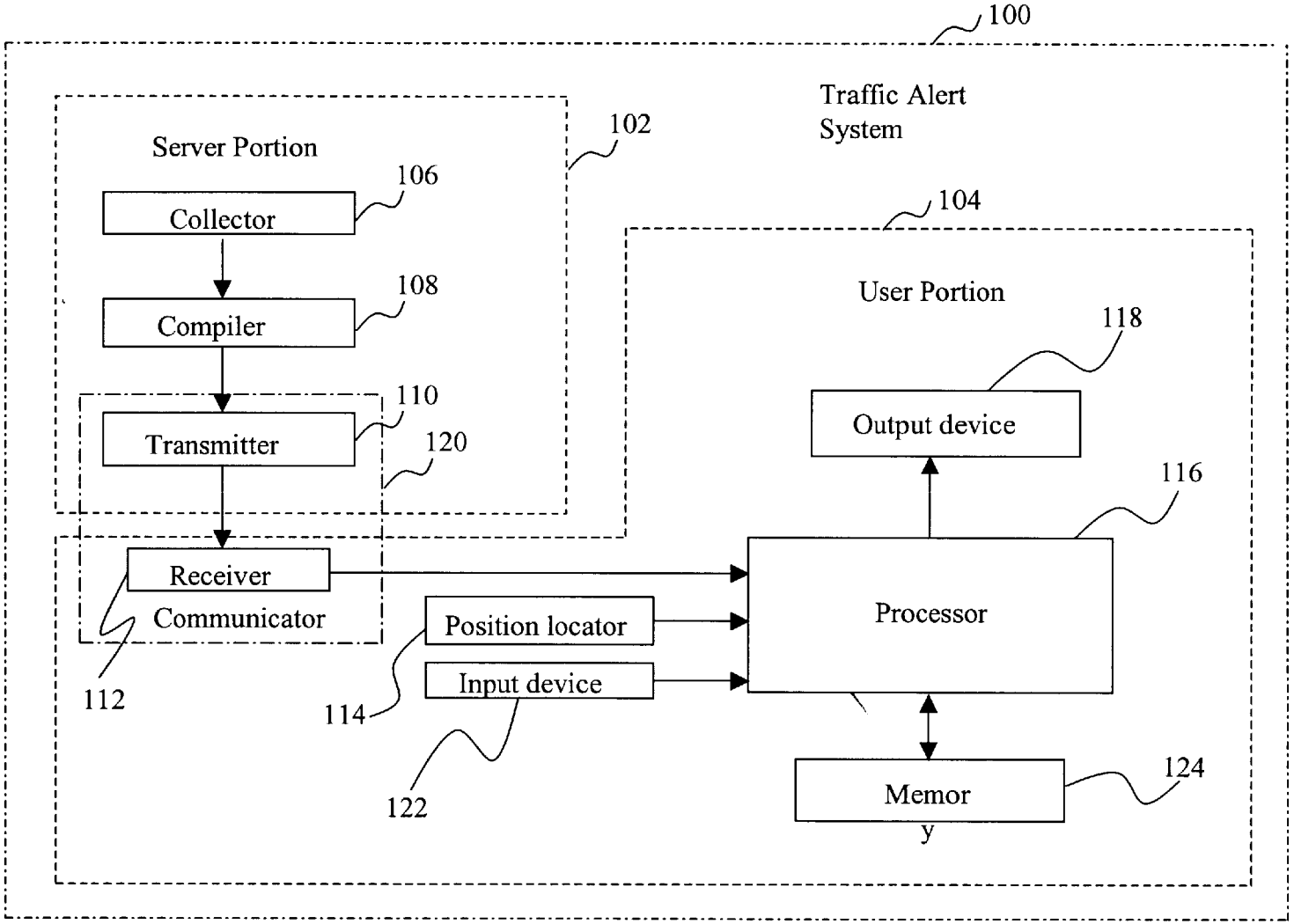
FIG. 1 is a block diagram depicting an embodiment of the present invention.

An embodiment of the present invention comprises a combination of several subsystems that provides a way to automatically detect if a driver is about to encounter a traffic alert. A block diagram depicting an embodiment of the present invention is shown in FIG. 1. This embodiment comprises a traffic alert system 100, which includes a server portion 102 and at least one user portion 104. The server portion 102 comprises a collector 106 that collects traffic alert information, a compiler 108 that compiles collected traffic alert information, and a transmitter 110 that transmits the compiled traffic alert information to the user portion 104. The user portion 104 comprises a receiver 112 for receiving the traffic alert information from the server portion 102, a position locator 114 for determining a time-stamped position of the user portion 104, a user portion processor 116 to receive the traffic alert information and the time-stamped position of the user portion, to calculate a vehicle trajectory, and to determine the traffic alert along the calculated vehicle trajectory, and an output device 118 to alert a user when the traffic alert is determined. Typically, the server portion 102 elements, the collector 106, the compiler 108, and the transmitter 110, are ground-based and the user portion 104 elements, the receiver 112, the position locator 114, the processor 116, and the traffic alert output device 118, are vehicle-based.

The collector 106 of the server portion 102 operates by collecting traffic alert information from numerous sources. The traffic alert information includes, at a minimum, the location of the traffic alert, with the preferred coordinate data being in latitude and longitude form. Other information describing the traffic alert could also be provided, with non-limiting examples including: the start time of the traffic alert, the severity of the traffic alert, and the type of traffic alert. Traffic alert information could include human encoded information and automatically collected information, from sources such as, for example, reports from radio and television stations, highway and maintenance departments, police departments, as well as information from cameras, sensors, airplanes, and helicopters. A compiler 108 compiles the collected traffic alert information into a traffic alert system-readable format. Map data, with street and/or freeway names, could be used to provide street-specific locations of traffic alerts. However, this would require a user portion processor 116 in the vehicle to be able to convert this data into latitude and longitude data or another form of data compatible with the user portion processor 116. A transmitter 110 communicates the compiled traffic alert information to the user portion 104. The transmitter 110 transmits the traffic alert information to the users of the service. The data rate may be quite small-as low as several hundred bytes per traffic alert-and may be rebroadcast every minute or so. The transmitter could include, but is not limited to, a sub-carrier from a satellite system or a system similar to a pager, or even broadcast from wireless phone type cells in the neighborhoods of the traffic alerts. The server portion 102 could be implemented using an infrastructure provided by a local service so long as the software and hardware are compatible with a user portion receiver 112 and the user portion processor 116.

The user portion 104 includes the user portion receiver 112, which receives the traffic alert information from the server portion 102. The combination of the server portion transmitter 110 and the user portion receiver 112 preferably form a communication device 120. The user portion also includes a position locator 114 for determining a time-stamped position of the user portion. The position locator 114 includes a means for identifying a current position preferably including a latitude and longitude location along with a position time-stamp. Non-limiting examples of the position locator 114 include, but are not limited to, a Global Positioning System (GPS), laser or inertial positioning equipment, and roadside electronic markers that identify a current position. The user portion processor 116 can be implemented as a general-purpose computer or a specialized computing device. The user portion processor 116 receives the traffic alert information from the receiver 112 and the time-stamped position of the user portion from the position locator 114. The user portion processor 116 calculates a vehicle trajectory based on the received time-stamped position. The user portion processor 116 compares the calculated vehicle trajectory with the traffic alert information from the receiver 112 to determine if there is a traffic alert along the calculated vehicle trajectory. If the traffic alert is correlated then an alert signal is sent to the user by an output device 118. The output device 118 announces the traffic alert, and any other pertinent information, potentially including, but not limited to the severity and estimated duration of the alert. Multiple output modes are possible and the traffic alert output device 118 may include, as non-limiting examples: a visual display, a map display, a heads-up visual traffic alert display system, a voice or a synthesized speech to announce the traffic alert and describe the location and any other encoded information, a natural language (NL) audio traffic alert interface, and audio warning sounds.

The user portion processor 116 receives position data from the position locator 114 to derive a time-stamped estimate of the vehicle's location. The user portion processor 116 calculates the vehicle trajectory based upon the time at which the vehicle passes through certain locations or the pattern of movement as determined by the sequence of positions of the vehicle. The vehicle trajectory includes speed and direction to form a velocity vector. To determine if there is a potential alarm for this vehicle, the user portion processor 116 would also need to perform, at a minimum, steps including:

a. The step of smoothing or averaging the vehicle velocity to provide a basis for estimating the path for the vehicle. Numerous signal-processing techniques are appropriate and may include, but are not limited to, simple averaging, least squares fitting to the trajectory line or curve and filtering may include Kalman and adaptive filtering. The smoothing is useful to reduce false alarms;

b. The step of determining estimated path of the vehicle. The estimated path includes, but is not limited to, a straight line trajectory based on the smoothed vehicle velocity or a more complex set of trajectories with associated confidence measures. Non-limiting examples of trajectory determination techniques include:

i. using a Gaussian distribution around a particular direction, or based on a map for example, showing that there is a high probability that the vehicle is traveling on a particular street or freeway, ii. using a learned or preplanned route known to the trajectory estimation method for example by interaction with an onboard navigation system to determine that a particular route plan is in effect, iii. searching through stored historical routes to see if the vehicle is currently on part of one of these routes, or iv. determining a traffic alert cone that is a forward-looking cone determined from the velocity vector and either a sub-set of the personalized user entered parameters or a set of default settings for the traffic alert cone angle and probability distributions where the predicted vehicle route becomes the path within the traffic alert cone.

c. The step of storing the coordinates and other information associated with a traffic alert; and d. The step of determining if, to what degree, and when the vehicle trajectory intersects the traffic alert. As a simple example, the algorithm could merely project a current velocity vector as a straight line and determine the closest distance to the coordinates of the traffic alert. The time of this closest approach could also be estimated. The potential for the traffic alert to affect the current trajectory would be calculated based on the closeness of approach and the estimated time. More complex algorithms can be applied based on constructing various trajectories and their estimated probabilities in order to determine a more analytic confidence level for encountering the traffic alert.

Additional embodiments may include a user input device 122 as well as a memory storage area 124 for storage of historical route database, user determined routes, and personalized user parameters. The personalized user parameters are ways that the user may personalize the user portion to output the desired warnings. The personalized user parameters may include but are not limited to user-determined route, traffic alert cone parameters, a time to intersect traffic alert for warning, and route weighting factors. The traffic alert cone parameters may define the width of the traffic alert cone and the length of the traffic alert cone. The time to intersect traffic alert for warnings defines the time to travel from the user portion current position to the location of the traffic alert. The route weighting factor is the weight to give each of the route considerations in determining the predicted vehicle route. The user input device 122 includes but is not limited to input of a route to use as well as input of personalized user parameters for traffic alerts. The user could have access to the selection of the threshold for alarm and/or selection of the algorithm in order to optimize the alarm verses false alarm rates for their particular driving area. In these additional embodiments, the user portion processor 116 would typically need to perform further steps including:

a. The step of comparing the route in use to routes previously used and routes that have been inputted by the user to increase the predictive accuracy while minimizing the amount of input required by the user; and b. The step of storing the user portion time-stamped positions for later comparison.

Figure 2:
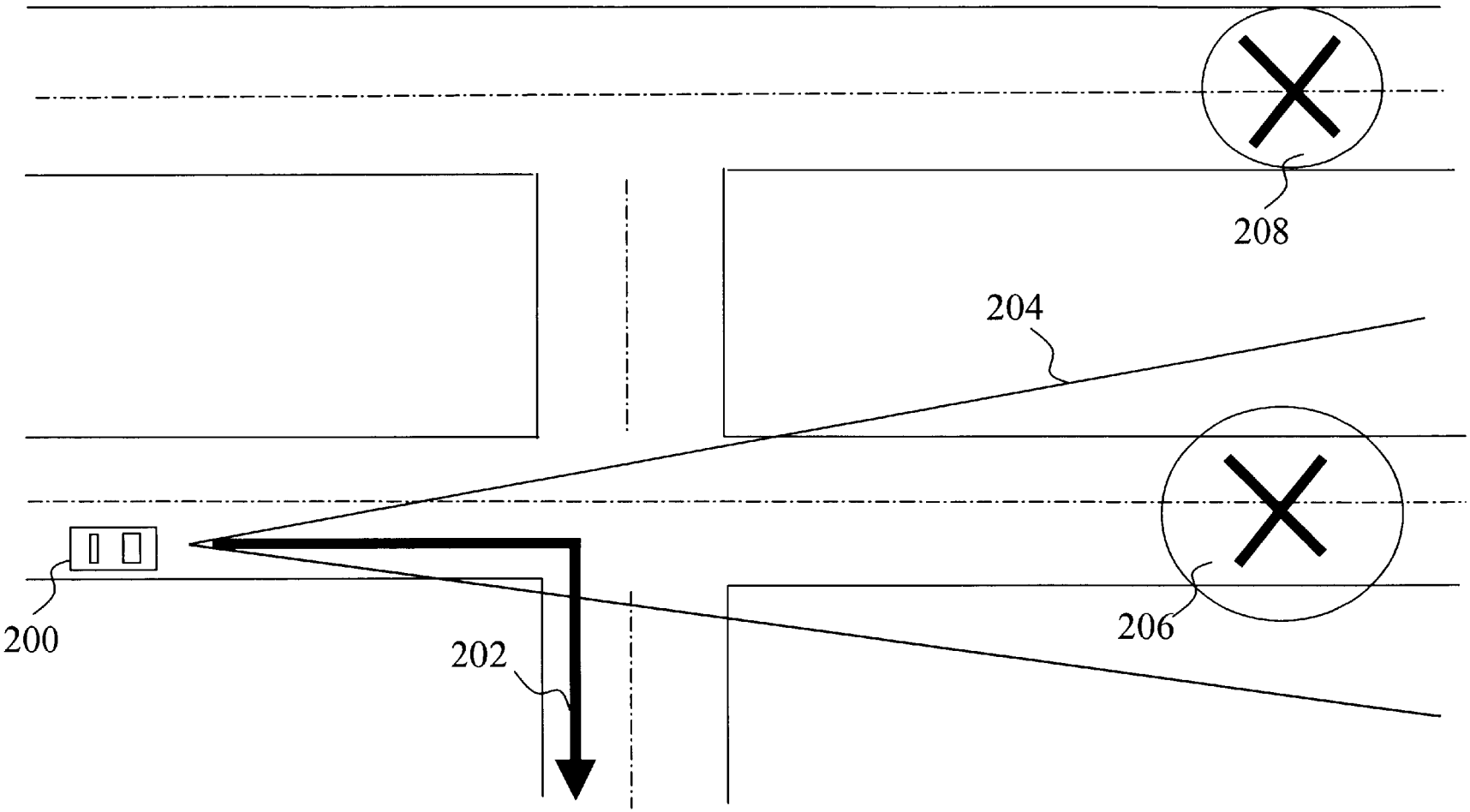
FIG. 2 is an illustration qualitatively depicting an example of the relationship of predicted vehicle routes to traffic alert warnings for an embodiment of the present invention.

An illustration qualitatively depicting an example of the relationship of predicted vehicle routes to traffic alert warnings for an embodiment of the present invention is shown in FIG. 2. Here a vehicle 200 is traveling down a street with a velocity vector. Non-limiting examples of determining the predicted vehicle route 202 could include:

a. user input, where the probability weight would be very high;

b. matching the current time-stamped positions with the historical route database, where the probability weight may vary depending on the frequency of use and how recently the route was traveled; or c. developing a traffic alert cone 204 calculated from the velocity vector where the probability weight is lower.

The traffic alert cone 204 could become the predicted vehicle route absent user entered or historical database routes. With a predicted vehicle route determined, the traffic alert warning is correlated by comparing the predicted vehicle route with the traffic alert information or alert areas. In this example, if the route 202 is determined from user entry or historical database, the probability is high that no alert is issued because the route 202 does not overlap with alert area 1 206 or alert area 2 208. If no route data is present, neither user entered nor in the historical database, the calculated vehicle trajectory, velocity vector, or the traffic alert cone 204 is used and there is a high probability for alert area 1 206 but a low probability for alert area 2 208. This is because the traffic alert cone 204 and alert area 1 206 overlap but the traffic alert cone 204 and alert area 2 208 do not overlap. Alert area 2 208 may be assigned a 0 value since it is outside the traffic alert cone 204 and alert area 1 206 may be assigned a 1 value since it is inside the traffic alert cone 204, or a Gaussian distribution centered on the cone axis may be used. Data fusion techniques or combinations of the techniques described may be used in determining the predicted vehicle route and in correlating the potential traffic alerts. This could range from simple linear to complicated homogeneous data solutions.

Figure 3:
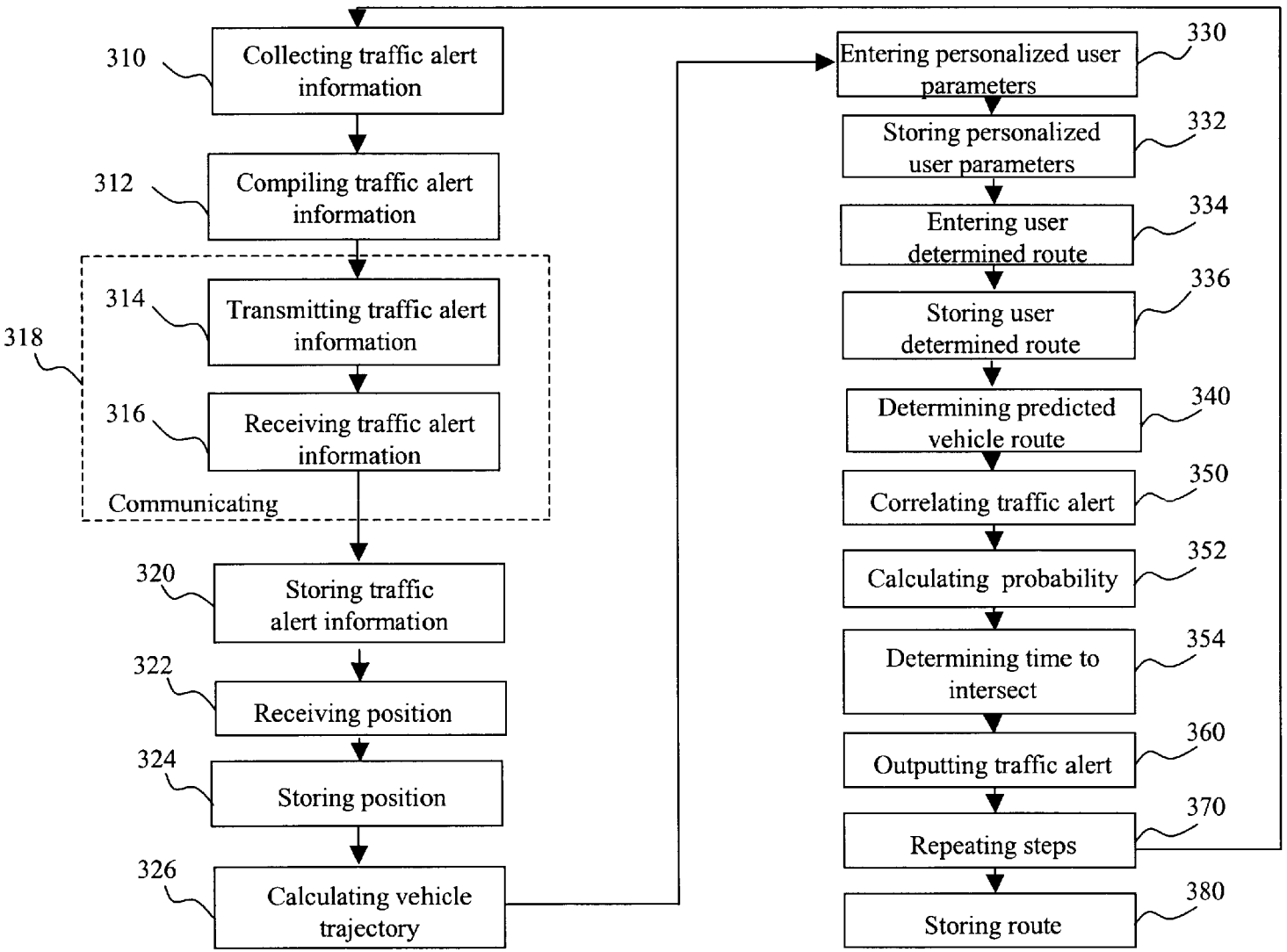
FIG. 3 is a flow diagram depicting the steps in the method of an embodiment of the present invention.

A flow diagram depicting the steps in the method of an embodiment of the present invention is shown in FIG. 3. This method comprises the following steps: first, a traffic alert information collecting step 310 is performed, wherein the traffic alert information including traffic alert locations is collected through a server portion from numerous sources. Next in a traffic alert information compiling step 312, the collected traffic alert information is compiled into a traffic alert system-readable format. Next in a traffic alert information transmitting step 314, the compiled traffic alert information is transmitted to the user portion. Next in a traffic alert information receiving step 316, the user portion receives the transmitted traffic alert information. The user portion communicating step 318 encompasses the traffic alert information transmitting step 314 by the server portion and the traffic alert information receiving step 316. Next in a traffic alert information storing step 320, the received traffic alert information may be stored in the memory storage area by user portion processor. Next in a position receiving step 322, a time-stamped position is received from the position locator and in a position storing step 324, the received time-stamped position is stored in the memory storage area in order to have this data for future computations of predicted vehicle route and historical routes. Next in a vehicle trajectory calculating step 326, the calculated vehicle trajectory is determined based on the received time-stamped position from the position locator.

The calculated vehicle trajectory may be farther refined by the following steps: Optionally a personalized user parameter entering step 330, in which a set of traffic alert cone parameters, a time to intersect traffic alert for warning, and route weighing factors are entered into the user portion processor via a user portion input device. If personalized user parameters were entered in the personalized user parameter entering step 330, they are stored in the personalized user parameters storing step 332, in a memory storage area. Next in an optional user determined route entering step 334, the user determined route is entered into the user portion processor via the user portion input device. If a user determined route was entered in the user determined route storing step 336, the user determined route is then stored in the memory storage area. The calculated vehicle trajectory could take the shape of a traffic alert cone with the angle and length of the traffic alert cone defined by the personalized user parameters or default. A predicted vehicle route determining step 340, in which the predicted vehicle route is established by comparing the calculated vehicle trajectory to both the user determined route in the memory storage area and the historical routes in the memory storage area. The route weighting factor in the personalized user parameters enables the user to define the weight factor for the calculated vehicle trajectory, the user determined route and the historical route database. The calculated vehicle trajectory or the traffic alert cone could become the predicted vehicle route absent user determined or historical database routes. The predicted vehicle route determining step 340 continues to update the probability of being on a certain historical route or the user determined route as the vehicle travels along the route.

Next in a traffic alert correlating step 350, the user portion processor correlates the predicted vehicle route with the traffic alert information stored in the traffic alert information storing step 320 to determine if there are any traffic alerts along the predicted vehicle route. The traffic alert is correlated when the predicted vehicle route and the traffic alert location coincide. The traffic alert correlating step 350 may be further defined by using the personalized user parameters stored in the personalized user parameters storing step 332 by including sub-steps:

a. A probability calculating step 352, wherein a traffic alert cone angle may be determined from user selected parameters or a default. The traffic alert area is correlated with the traffic alert cone to determine whether an intersect is likely; and b. A time to intersect determining step 354, wherein the traffic alerts correlating step 350 is further defined by using the personalized user parameters stored in the personalized user parameters storing step 332 for correlating a time to intersect the traffic alert along the predicted vehicle route. This is accomplished by comparing the location of the predicted vehicle route 340 and the stored traffic alert information 320 with the location, direction, and velocity of the vehicle to determine the time to intersect the traffic alert 354 and further comparing the determined time to intersect 354 with the personalized user parameters 332 for the time to intersect to correlate if the probability and time are within the personalized user parameter.

Next in a traffic alert outputting step 360, the calculated vehicle trajectory or the predicted vehicle route is compared with the traffic alert location and when they coincide an output is sent to the output device. The traffic alert outputting step 360 is further defined when the personalized user parameters of probability and time to intersect are used. With probability and time to intersect, the traffic alert outputting step 360 is accomplished when the traffic alert falls within the user parameters. An example of this is where the probability and time to intersect fall with the user parameters and the user desires a probability of 75% and a time of 3 minutes but the processor calculates a 50% probability and time of 10 minutes therefore no warning would be issued.

Next in a repeating step 370, the traffic alert information collecting step 310 through the traffic alert outputting step 360, are repeated until the end event occurs. The end event signals the user portion that the route is complete and signals the user portion to store the route in the historical database for future use. Examples of an end event may include but are not limited to: The time-stamped position for the user portion has remained constant for a period of time, the ignition is turned off, and the user designates the end of the route. Next in a route storing step 380, the sum of the time-stamped positions is stored in the historical route database memory storage area when the end event occurs.

Figure 4:
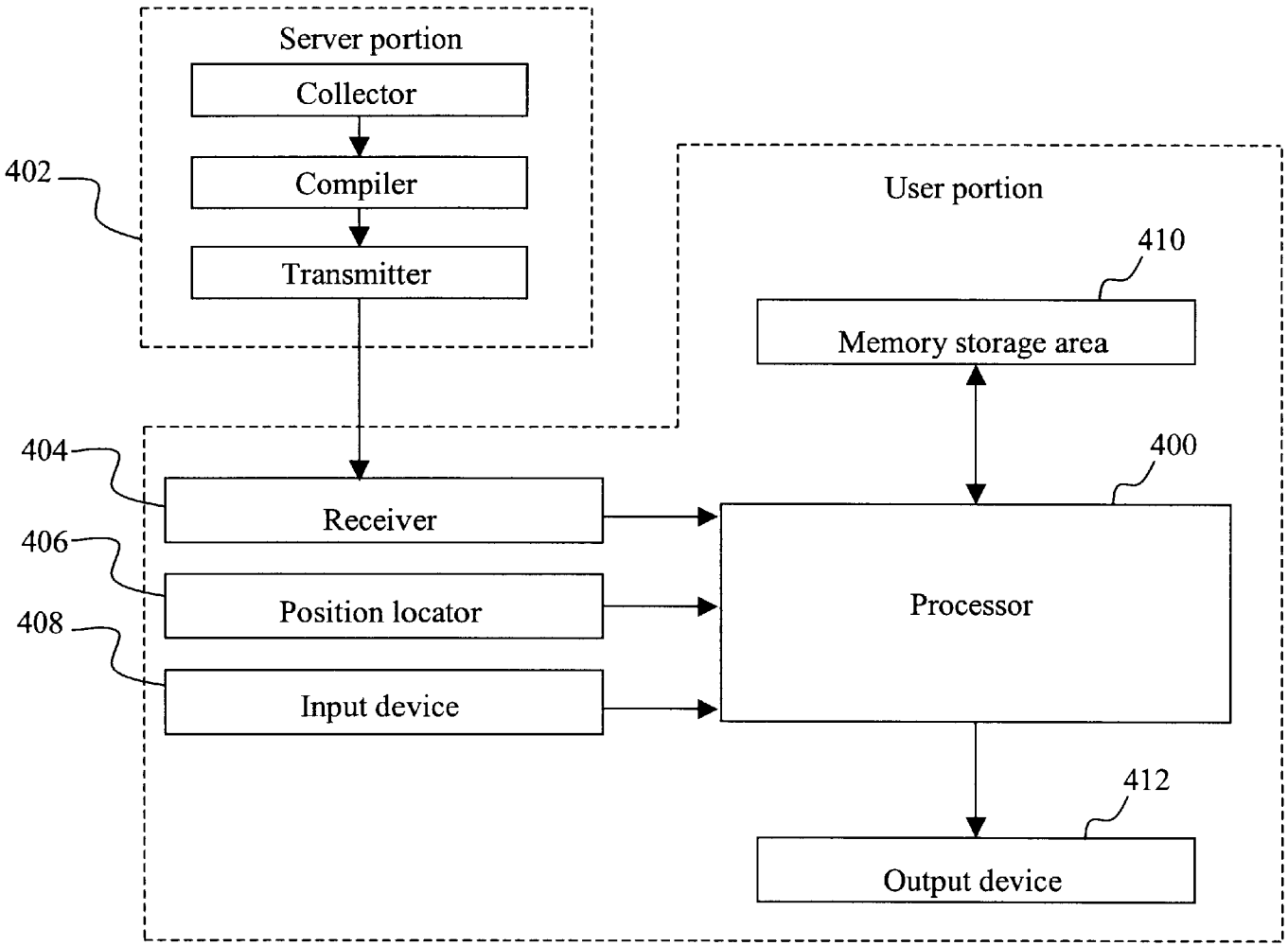
FIG. 4 is a block diagram illustrating the flow paths of input and output information associated with the user portion processor of an embodiment of the present invention.

A block diagram illustrating the flow of input and output information associated with a user portion processor 400 is shown in FIG. 4. The user portion processor 400 receives traffic alert information from a server portion 402 through a receiver 404. The user portion processor 400 receives time-stamped position information from a position locator 406 for calculating a current trajectory and for updating a historical route database in the memory storage area. The user portion processor 400 may receive input through an input device 408 from the user and the input would be stored in a memory storage area 410. As traffic alerts are determined they are output to the user by an output device 412. Information and data are transferred between the user portion processor 400 and the memory storage area 410 as needed to make calculations and store data for future calculations.

Figure 5:
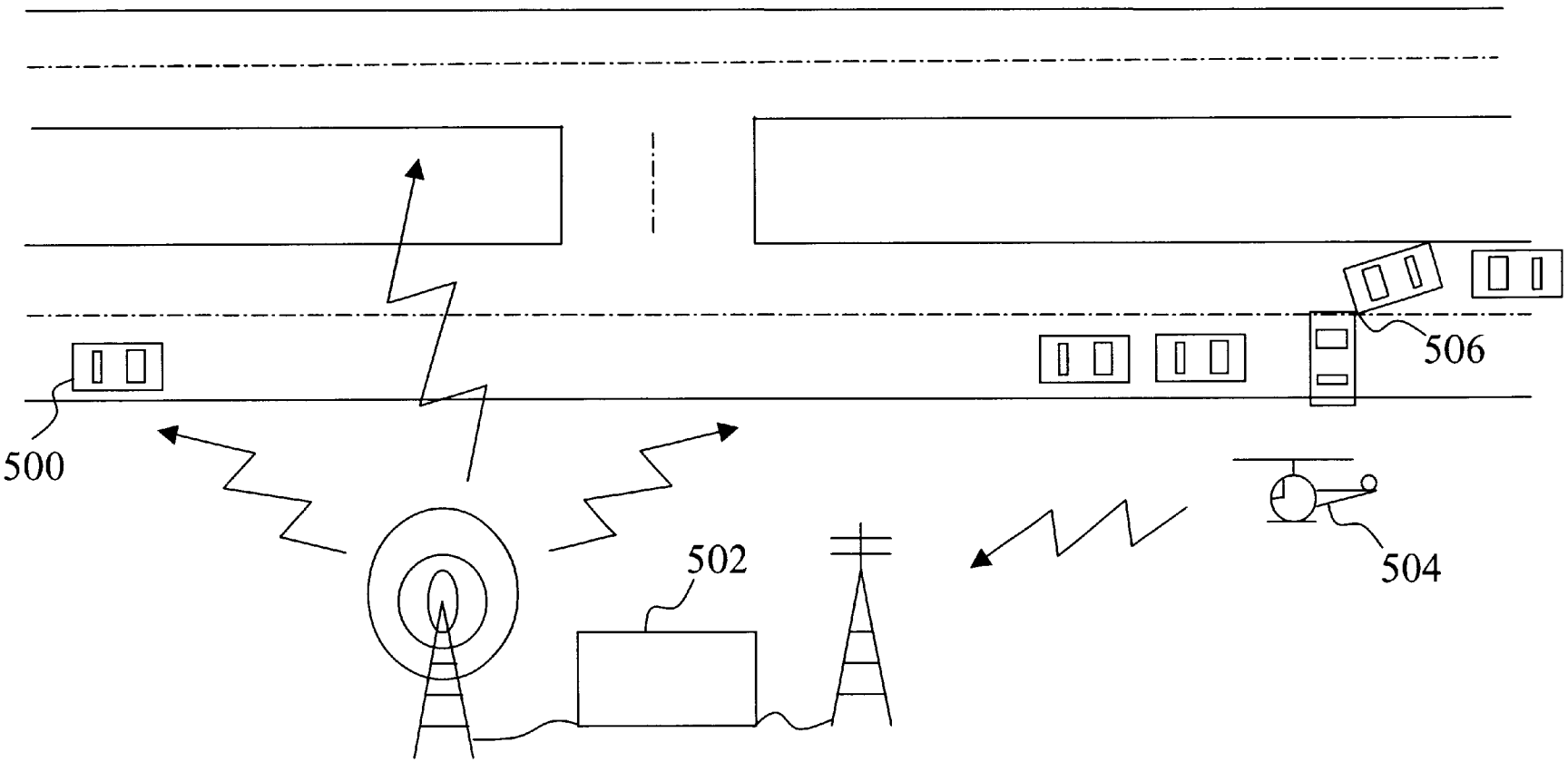
FIG. 5 is an illustration qualitatively depicting the operation of an embodiment of the present invention.

An illustrative depiction of an embodiment of the present invention in the context of a subscriber user portion is shown in FIG. 5. In this embodiment, the user portion is incorporated into an automobile 500. In the illustration, the automobile user portion 500 is traveling down a street analyzing traffic alert information from the server portion 502. The server portion 502 collects traffic alert information from a helicopter 504 that observes a traffic jam due to an automobile accident 506. The helicopter 504 sends a traffic report that details the nature, location, and time of the problem to a central location. The server portion 502 collects the traffic alert information and compiles it into a traffic alert system-readable format by the user portion and then transmits the traffic alert information to the automobile user portion 500. The automobile user portion 500 receives the traffic alert and the processor determines that the traffic alert is along the calculated vehicle trajectory as well as the predicted route. The traffic alert is output to the output device. With minimal effort the user is able to alter the route and avoid the traffic jam.

What is claimed is:

1. A traffic alert user portion for receiving collected, compiled, and transmitted traffic alert information including traffic alert location from a traffic alert server portion, the traffic alert user portion comprising:

a. a receiver in communication with the server portion for receiving the traffic alert information;

b. a position locator for determining a time-stamped position of the user portion;

c. a user portion processor operationally connected with the receiver and the position locator to receive the traffic alert information and the time-stamped position of the user portion, to calculate a vehicle trajectory and a velocity based on the time-stamped position, and to correlate a traffic alert along the calculated vehicle trajectory;

d. a memory storage area including a historical route database wherein the memory storage area is operationally connected with the user portion processor to store and retrieve historical route data;

e. a predicted vehicle route determined within the user portion processor by analyzing the historical route database to locate a potential match with the calculated vehicle trajectory, and when the potential match is found, the potential match becomes the predicted vehicle route used, otherwise, the calculated vehicle trajectory is used as the predicted vehicle route;

f. an output device operationally connected with the user portion processor to alert a user when the traffic alert is correlated;

g. a sum of the time-stamped positions is stored by the user portion processor in the historical route database in the memory storage area upon the occurrence of an end event;

h. a personalized user parameter database including a user determined route, and at least one route weighing factor are stored within the memory storage area;

i. an input device operationally connected with the user portion processor for entering the personalized user parameters into the user portion processor for subsequent storage in the memory storage area; and wherein j. the user portion processor further determines the predicted vehicle route by comparing within the user portion processor the user determined route, the historical route database, and the calculated vehicle trajectory using the route weighing factor entered by the user to determine the weight to give each comparison in selecting from the group consisting of the user determined route, the historical route database, and the calculated vehicle trajectory.

2. A traffic alert user portion as set forth in claim 1, wherein the traffic alert user portion further comprises:

a. a personalized user parameter database including, traffic alert cone parameters, and a time to intersect traffic alert for warning are stored within the memory storage area; and b. the traffic alert can be further personalized by the user portion processor by including the personalized user parameters of the traffic alert cone parameters, and the time to intersect traffic alert for warning in the correlations to determine whether to issue a traffic alert.

3. A traffic alert system for personalized traffic alerts comprising:

a. a traffic alert server portion including:

i. a means for collecting a traffic alert information from numerous sources, ii. a means for compiling the traffic alert information into a traffic alert system-readable format operationally connected with the means of collecting, and iii. a means for transmitting the traffic alert information to a user portion with the means for communicating operationally connected with the means of compiling;

b. a traffic alert user portion in communication with the server portion including:

i. a user portion receiver in communication with the server portion to receive the transmitted traffic alert information in the user portion from the server portion, ii. a user portion processor operationally connected with the user portion receiver to receive the received traffic alert information, iii. an input device operationally connected with the user portion processor to allow for entry of a user determined route and personalized user parameters into the user portion processor, iv. a position locator including a time-stamped position output operationally connected with the user portion processor for sending the time-stamped output into the user portion processor, v. a memory storage area including a historical route database, for storing the historical route database, the personalized user parameters and the user determined route operationally connected with the user portion processor, vi. the user portion processor further configured to determine a calculated vehicle trajectory based on the received time-stamped position, to compare the calculated vehicle trajectory with both the user determined route and the stored historical route database to determine a predicted vehicle route, to correlate a traffic alert along a route by correlating the traffic alert information locations and the predicted vehicle route, to determine a probability of a traffic alert intersect, to determine a time to intersect the traffic alert along the predicted vehicle route, and to determine if the time and the probability are within the personalized user parameters, vii. an output device operationally connected with the user portion processor to output the traffic alert to the user, and viii. the user portion processor further configured to sum and store the time-stamped positions along the route in the historical route database for later reference.

4. A traffic alert user portion as set forth in claim 3, wherein the traffic alert user portion further comprises:

a. a personalized user parameter database including, traffic alert cone parameters, and a time to intersect traffic alert for warning are stored within the memory storage area; and b. the traffic alert can be further personalized by the user portion processor by including the personalized user parameters of the traffic alert cone parameters, and the time to intersect traffic alert for warning in the correlations to determine whether to issue a traffic alert.

5. A method for providing personalized traffic alerts along a vehicle route to at least one user portion, with each user portion including a receiver for traffic alert information from an information source, the receiver operationally connected with a user portion processor for calculating vehicle trajectory and correlating a traffic alert operationally connected with a position locator operationally connected a memory storage area including a historical route database operationally connected with the user portion processor operationally connected with an output device, the method comprising the steps of:

a. receiving the traffic alert information including a traffic alert location for the traffic alert information from the information source;

b. receiving a time-stamped position from the position locator;

c. calculating a vehicle trajectory based on the received time-stamped position;

d. determining a predicted vehicle route by analyzing the historical route database to locate a potential match with the calculated vehicle trajectory, and when the potential match is found the potential match becomes the predicted vehicle route, otherwise the calculated vehicle trajectory is the predicted vehicle route;

e. correlating the traffic alert along the predicted vehicle route by comparing the received traffic alert information location and the predicted vehicle route to determine if the received traffic alert information location and the predicted vehicle route coincide;

f. outputting the correlated traffic alert to the output device;

g. entering the personalized user parameters including a traffic alert cone parameters, a time to intersect traffic alert for warning, and at least one route weighing factor into the user portion processor via the input device when desired;

h. storing the entered personalized user parameters in the memory storage area;

i. receiving the user determined route into the user portion processor via the input device when desired;

j. storing the user determined route, when entered, in the user determined route database in the memory storage area;

k. determining the predicted vehicle route by analyzing the calculated vehicle trajectory, the historical route database, and the user determined route with the personalized user parameters for the route weighting factor to determine which has the highest route weighting factor and is determined to be the predicted vehicle route;

l. correlating the traffic alert information location and the predicted vehicle route to determine if the traffic alert information location and the predicted vehicle route coincide, by further correlating a traffic alert intersect probability by comparing the predicted vehicle route, the traffic alert cone parameters, and the traffic alert area with the personalized user parameters to determine if an intersection with the traffic alert is probable, and by further correlating a time to intersect the traffic alert along the predicted vehicle route by comparing the predicted vehicle route and the traffic alert information to derive the time to intersect the traffic alert and comparing the time to intersect with the personalized user parameters for the time to intersect to correlate if the time to intersect the traffic alert parameters are met;

m. outputting a signal from the output device when an intersection with a traffic alert is probable as determined in step f;

n. repeating the receiving step a through the correlating step e and the entering step g through the outputting step m until the end event; and o. storing a sum of the time-stamped positions in the historical route database memory storage area for later use in analyzing the historical route database.

* * * * *